US011920833B2

(12) United States Patent
Snider et al.

(10) Patent No.: US 11,920,833 B2
(45) Date of Patent: Mar. 5, 2024

(54) HEAT EXCHANGER FOR A HVAC UNIT

(71) Applicant: Johnson Controls Tyco IP Holdings LLP, Milwaukee, WI (US)

(72) Inventors: Ryan L. Snider, York, PA (US); Rajiv K. Karkhanis, York, PA (US); Chandra S. Yelamanchili, York, PA (US); Curtis W. Caskey, Dallastown, PA (US); Kevin R. Stockton, York, PA (US); Nicholas P. Mislak, Bel Air, MD (US); Douglas A. Kester, York, PA (US); Troy E. Smith, York, PA (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 0 days.

(21) Appl. No.: 17/694,426

(22) Filed: Mar. 14, 2022

(65) Prior Publication Data

US 2022/0316770 A1 Oct. 6, 2022

Related U.S. Application Data

(63) Continuation of application No. 15/717,743, filed on Sep. 27, 2017, now Pat. No. 11,274,861.

(60) Provisional application No. 62/406,347, filed on Oct. 10, 2016.

(51) Int. Cl.

| | |
|---|---|
| ***F25B 25/00*** | (2006.01) |
| ***F25B 9/00*** | (2006.01) |
| ***F25B 49/00*** | (2006.01) |

(52) U.S. Cl.

CPC ..... *F25B 25/005* (2013.01); *F25B 9/002* (2013.01); *F25B 49/005* (2013.01); *F25B 2400/12* (2013.01); *F25B 2400/121* (2013.01)

(58) Field of Classification Search

CPC .... F25B 2400/12–121; F25B 2500/221; F25B 2500/22; F25B 25/005; F25B 9/002; F25B 49/005; F24F 1/02–104

See application file for complete search history.

(56) References Cited

U.S. PATENT DOCUMENTS

| | | | |
|---|---|---|---|
| 1,963,698 | A | 6/1934 | Garre, Jr. |
| 2,246,999 | A | 6/1941 | Morrison |
| 2,336,066 | A | 12/1943 | Cain |
| 2,939,296 | A | 6/1960 | Coblentz |
| 3,415,073 | A | 12/1968 | Ammons |
| 4,107,942 | A | 8/1978 | Fairman |
| 4,399,862 | A | 8/1983 | Hile |

(Continued)

OTHER PUBLICATIONS

"Definition of Isolate", https://www.dictionary.com/browse/isolate, Accessed Dec. 18, 2019 (Year:2019), 6 pgs.

*Primary Examiner* — Cassey D Bauer

(74) *Attorney, Agent, or Firm* — Fletcher Yoder, P.C.

(57) ABSTRACT

A heating, ventilating, and air conditioning (HVAC) system includes a refrigerant loop having a compressor, where the compressor is configured to circulate a refrigerant through the refrigerant loop, a first heat exchanger disposed along the refrigerant loop, where the first heat exchanger is configured to place the refrigerant in a first heat exchange relationship with a working fluid, and an air handling unit having a second heat exchanger, where the second heat exchanger is configured to place the working fluid in a second heat exchange relationship with an airflow, and where the air handling unit is isolated from the first heat exchanger to reduce or eliminate mixing of refrigerant with the airflow.

19 Claims, 7 Drawing Sheets

(56) References Cited

U.S. PATENT DOCUMENTS

| | | | |
|---|---|---|---|
| 5,253,805 | A | 10/1993 | Swenson |
| 5,351,502 | A | 10/1994 | Gilles et al. |
| 5,366,153 | A | 11/1994 | Swenson |
| 5,558,273 | A | 9/1996 | Swenson et al. |
| 5,784,893 | A | 7/1998 | Furuhama et al. |
| 5,946,939 | A | 9/1999 | Matsushima et al. |
| 6,085,531 | A | 7/2000 | Numoto et al. |
| 6,434,969 | B1 | 8/2002 | Sosnowski |
| 9,835,342 | B2 | 12/2017 | Alazazmeh et al. |
| 2013/0336642 | A1 | 12/2013 | Lord et al. |
| 2014/0144522 | A1 | 5/2014 | Pine et al. |
| 2014/0260376 | A1 | 9/2014 | Kopko et al. |
| 2014/0260404 | A1 | 9/2014 | Verma et al. |
| 2015/0184885 | A1 | 7/2015 | Prins |

HEAT EXCHANGER FOR A HVAC UNIT

CROSS REFERENCE TO RELATED APPLICATIONS

This application is a continuation of U.S. patent application Ser. No. 15/717,743, entitled "Heat Exchanger For A HVAC Unit," filed Sep. 27, 2017, which claims priority to and the benefit of U.S. Provisional Patent Application No. 62/406,347, entitled "Single-Packaged AC Unit with Intermediate Water Heat Exchanger Isolating Refrigerant from AHU Section," filed Oct. 10, 2016, each of which is hereby incorporated by reference in its entirety.

BACKGROUND

The present disclosure relates generally to environmental control systems, and more particularly, to an intermediate heat exchanger for a HVAC unit.

Environmental control systems are utilized in residential, commercial, and industrial environments to control environmental properties, such as temperature and humidity, for occupants of the respective environments. The environmental control system may control the environmental properties through control of an airflow delivered to the environment. For example, a heating, ventilating, and air conditioning (HVAC) system routes the airflow through a heat exchanger prior to delivery to the environment. The heat exchanger transfers thermal energy from a fluid flowing through the heat exchanger to the airflow to increase or decrease a temperature of the airflow. In some cases, the fluid flowing through the heat exchanger may be exposed to the airflow directed to the environment.

SUMMARY

In one embodiment, a heating, ventilating, and air conditioning (HVAC) system includes a refrigerant loop having a compressor, where the compressor is configured to circulate a refrigerant through the refrigerant loop, a first heat exchanger disposed along the refrigerant loop, where the first heat exchanger is configured to place the refrigerant in a first heat exchange relationship with a working fluid, and an air handling unit having a second heat exchanger, where the second heat exchanger is configured to place the working fluid in a second heat exchange relationship with an airflow, and where the air handling unit is isolated from the first heat exchanger to reduce or eliminate mixing of refrigerant with the airflow.

In another embodiment, a single-packaged heating, ventilating, and air conditioning (HVAC) unit includes a housing, a refrigerant loop disposed in the housing, where the refrigerant loop has a compressor, and where the compressor is configured to circulate a refrigerant through the refrigerant loop, a first heat exchanger disposed in the housing and along the refrigerant loop, where the first heat exchanger is configured to place the refrigerant in a first heat exchange relationship with a working fluid, an air handling unit disposed in the housing, where the air handling unit includes a second heat exchanger, and where the second heat exchanger is configured to place the working fluid in a second heat exchange relationship with an airflow, and a barrier disposed in the housing and configured to isolate the first heat exchanger from the air handling unit to reduce or eliminate mixing of refrigerant with the airflow.

In an another embodiment, a method of operating a heating, ventilating, and air conditioning (HVAC) system includes circulating a refrigerant through a first heat exchanger disposed along a refrigerant loop of the HVAC system to transfer heat between the refrigerant and a working fluid, directing the working fluid from the first heat exchanger to a second heat exchanger to transfer heat between the working fluid and an airflow to a building, where the second heat exchanger is positioned to isolate the airflow from the refrigerant loop, and where the first heat exchanger and the airflow heat exchanger are packaged in a single unit, and directing the airflow into the building.

DRAWINGS

DETAILED DESCRIPTION

Embodiments of the present disclosure are directed toward a rooftop or other outdoor unit that includes an intermediate heat exchanger for isolating a portion of a heating, ventilating, and air conditioning (HVAC) system that circulates refrigerant from an air handling unit of the HVAC system. As will be appreciated, traditional refrigerants utilized in HVAC systems include various substances that may enable efficient heat transfer, but may have undesirable effects on the environment. Accordingly, existing HVAC systems may utilize refrigerants that have a reduced impact on the environment to comply with environmental standards and regulations. Unfortunately, such refrigerants that are utilized to comply with such standards and regulations may not be suitable for mixing with an airflow that is ultimately directed to a temperature controlled environment.

It is now recognized that isolating portions of outdoor HVAC units that circulate refrigerant from an air handling unit of the HVAC unit blocks refrigerant from mixing with the airflow supplied to the temperature controlled environment, such as a building, a room, a house, among others. As such, refrigerant that escapes from a refrigerant loop of the outdoor HVAC unit is not exposed to the airflow. For example, embodiments of the present disclosure are directed to an intermediate heat exchanger for an outdoor HVAC unit that isolates a refrigerant circulating portion of the outdoor HVAC unit from an air handling unit of the outdoor HVAC unit. In some embodiments, the intermediate heat exchanger includes a brazed plate heat exchanger that places refrigerant from the refrigerant circulating portion of the outdoor HVAC unit in a heat exchange relationship with an intermediate working fluid, such as water, glycol, a water-glycol mixture, carbon dioxide ($CO_2$), or a low global warming potential (GWP) refrigerant. The intermediate working fluid is then directed to the air handling unit where the intermediate working fluid is placed in a heat exchange relationship with an airflow that is directed into the temperature controlled environment. Accordingly, refrigerant that escapes from the refrigerant loop of the HVAC unit is isolated from the airflow.

Figure 1:
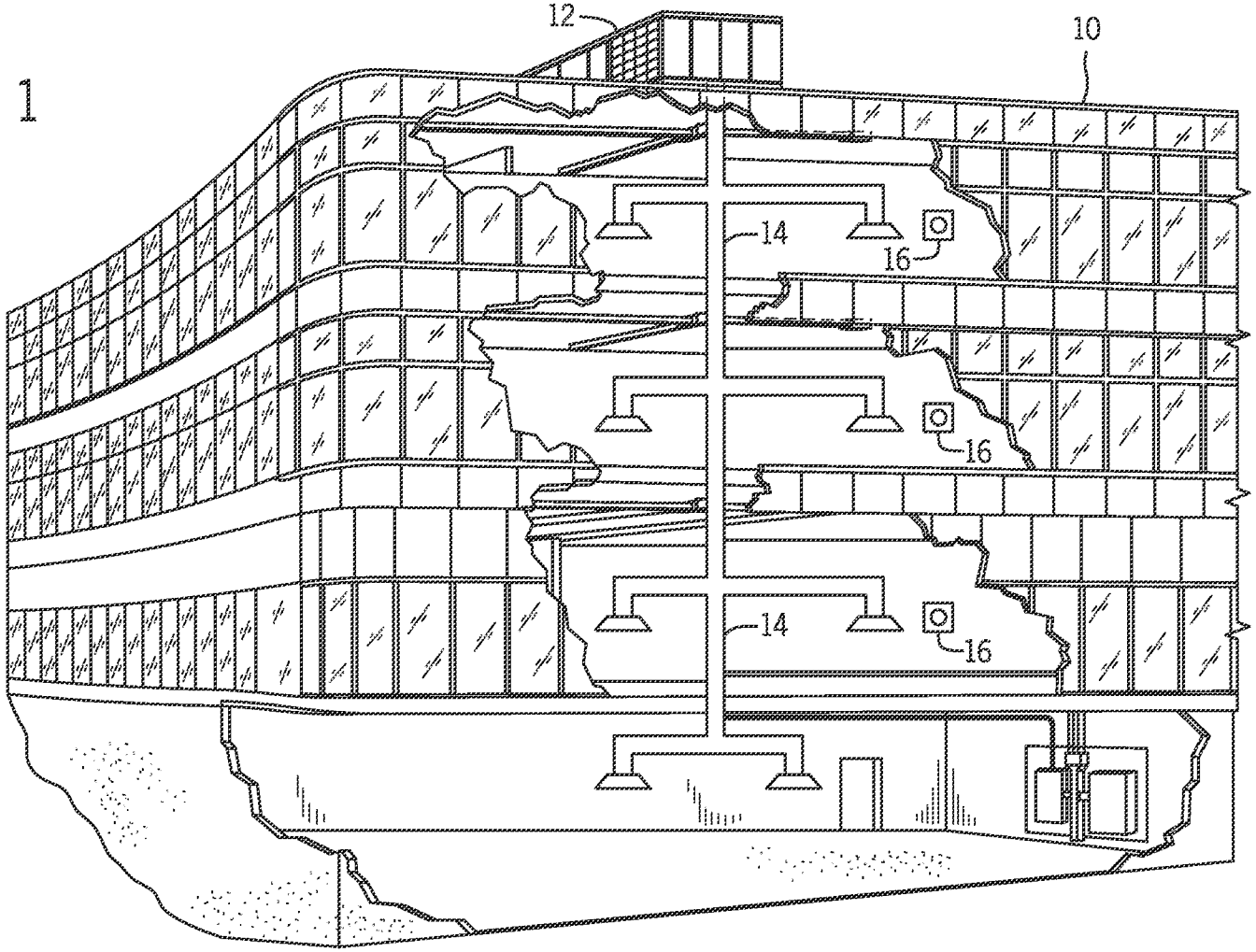
FIG. 1 is a schematic of an environmental control for building environmental management that may employ one or more HVAC units, in accordance with an aspect of the present disclosure.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
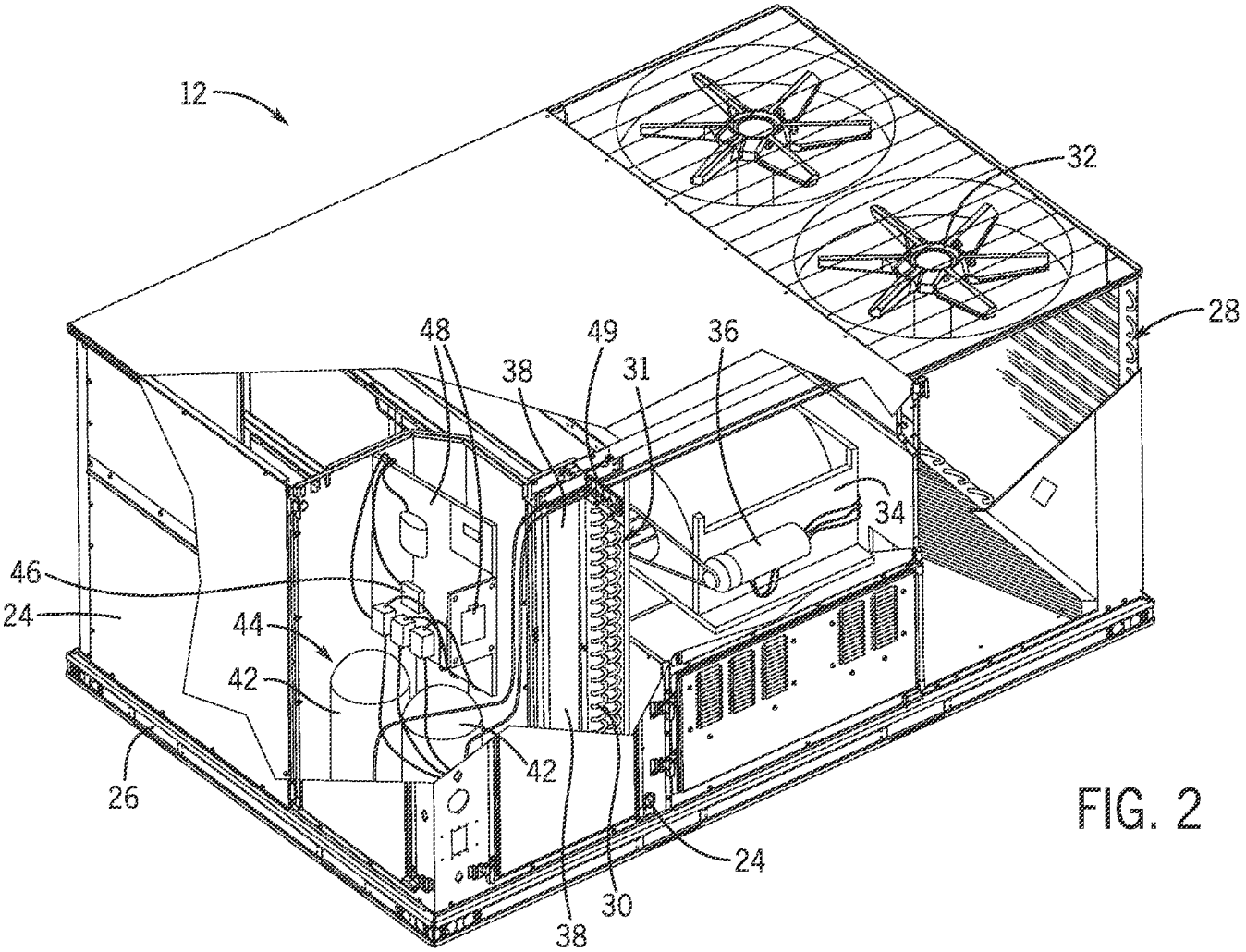
FIG. 2 is a perspective view of an embodiment of the environmental control system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant (for example, R-410A, steam, or water) through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms (one or more being referred to herein separately or collectively as the control device 16). The control circuitry may be configured to control operation of the equipment, provide alarms, and monitor safety switches. Wiring 49 may connect the control board 48 and the terminal block 46 to the equipment of the HVAC unit 12.

Figure 3:
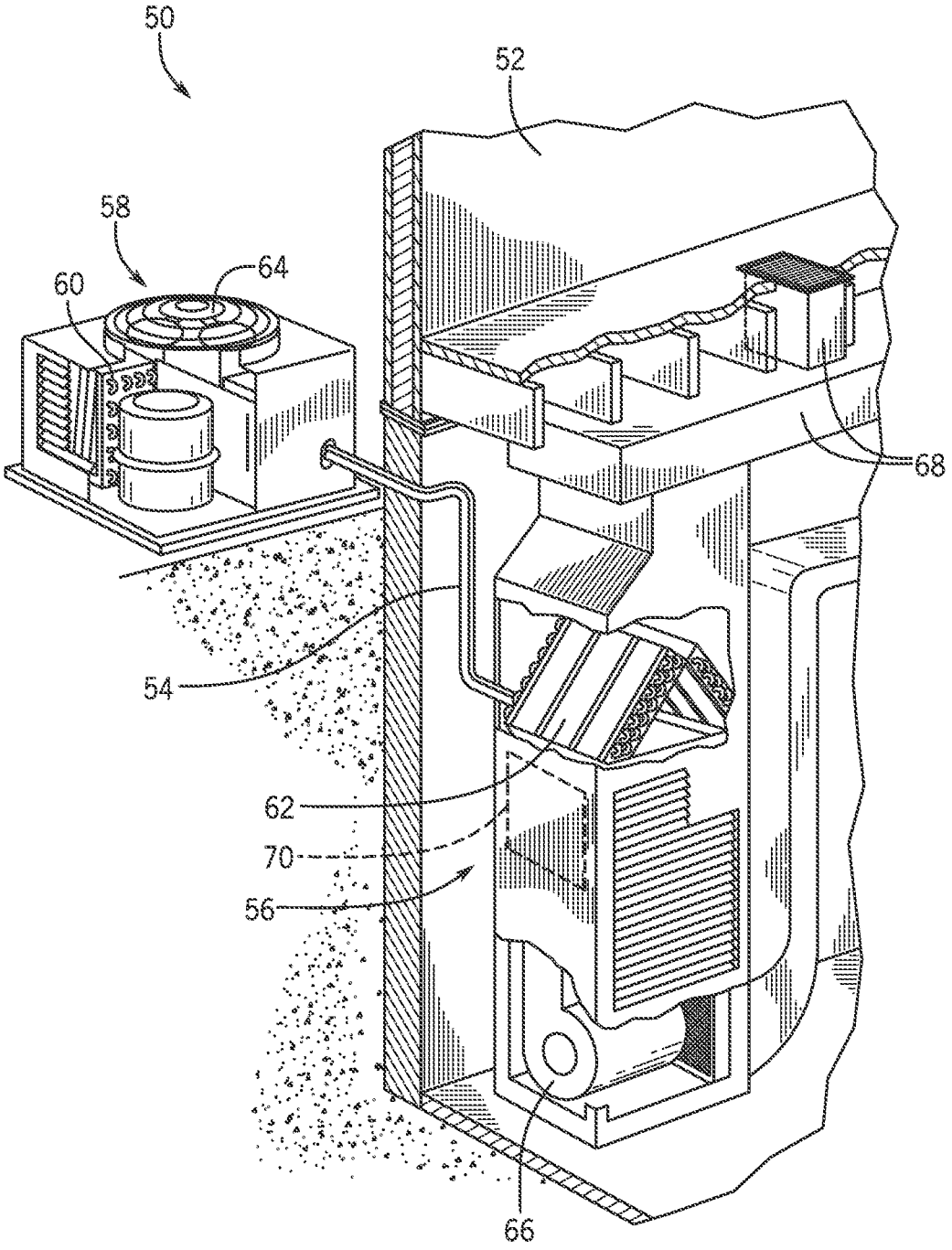
FIG. 3 is a schematic of a residential heating and cooling system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant (which may be expanded by an expansion device, not shown) and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat (plus a small amount), the residential heating and cooling system 50 may become operative to refrigerate additional air for circulation through the residence 52. When the temperature reaches the set point (minus a small amount), the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger (that is, separate from heat exchanger 62), such that air directed by the blower 66 passes over the tubes or pipes and extracts heat from the combustion products. The heated air may then be routed from the furnace system 70 to the ductwork 68 for heating the residence 52.

Figure 4:
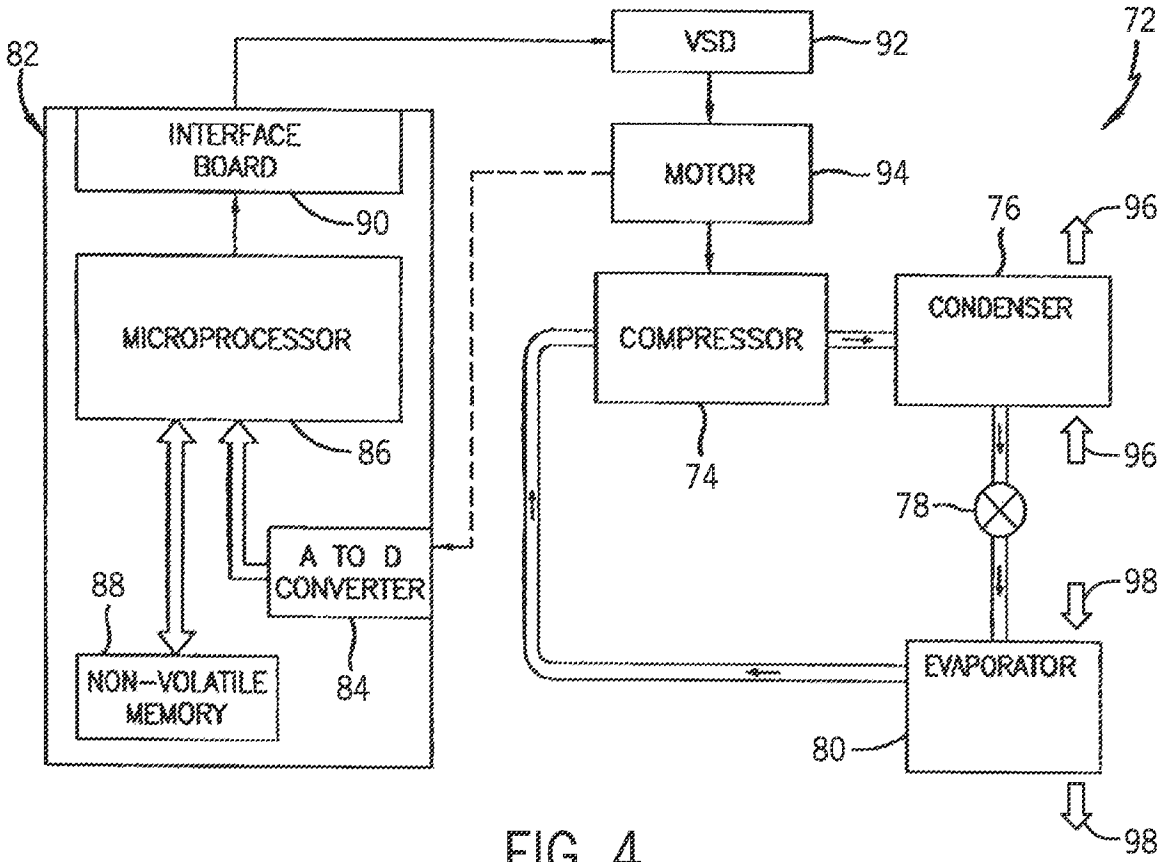
FIG. 4 is a schematic of an embodiment of a vapor compression system that can be used in any of the systems of FIGS. 1-3, in accordance with an aspect the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, or other heat pump or refrigeration applications.

As set forth above, embodiments of the present disclosure are directed to the HVAC unit 12 having an intermediate heat exchanger that isolates refrigerant flowing through a refrigerant loop from an airflow that is ultimately directed into the building 10. For example, the intermediate heat exchanger may place the refrigerant of the refrigerant loop in a heat exchange relationship with an intermediate working fluid, such as water, glycol, a water-glycol mixture, carbon dioxide ($CO_2$), and/or a refrigerant. The intermediate working fluid may then be directed to the air handling unit of the HVAC unit 12 to exchange heat with the airflow directed into the building 10. In some embodiments, the refrigerant that is circulated through the refrigerant loop of the HVAC unit 12, such as R32, R534, R290, R452B, R455A, R1234yf, ammonia, or a combination thereof, may not be suitable for circulating through the building 10. As such, should the refrigerant escape from the refrigerant loop, such as through a leak, the refrigerant will not mix with the airflow to the building 10.

Figure 5:
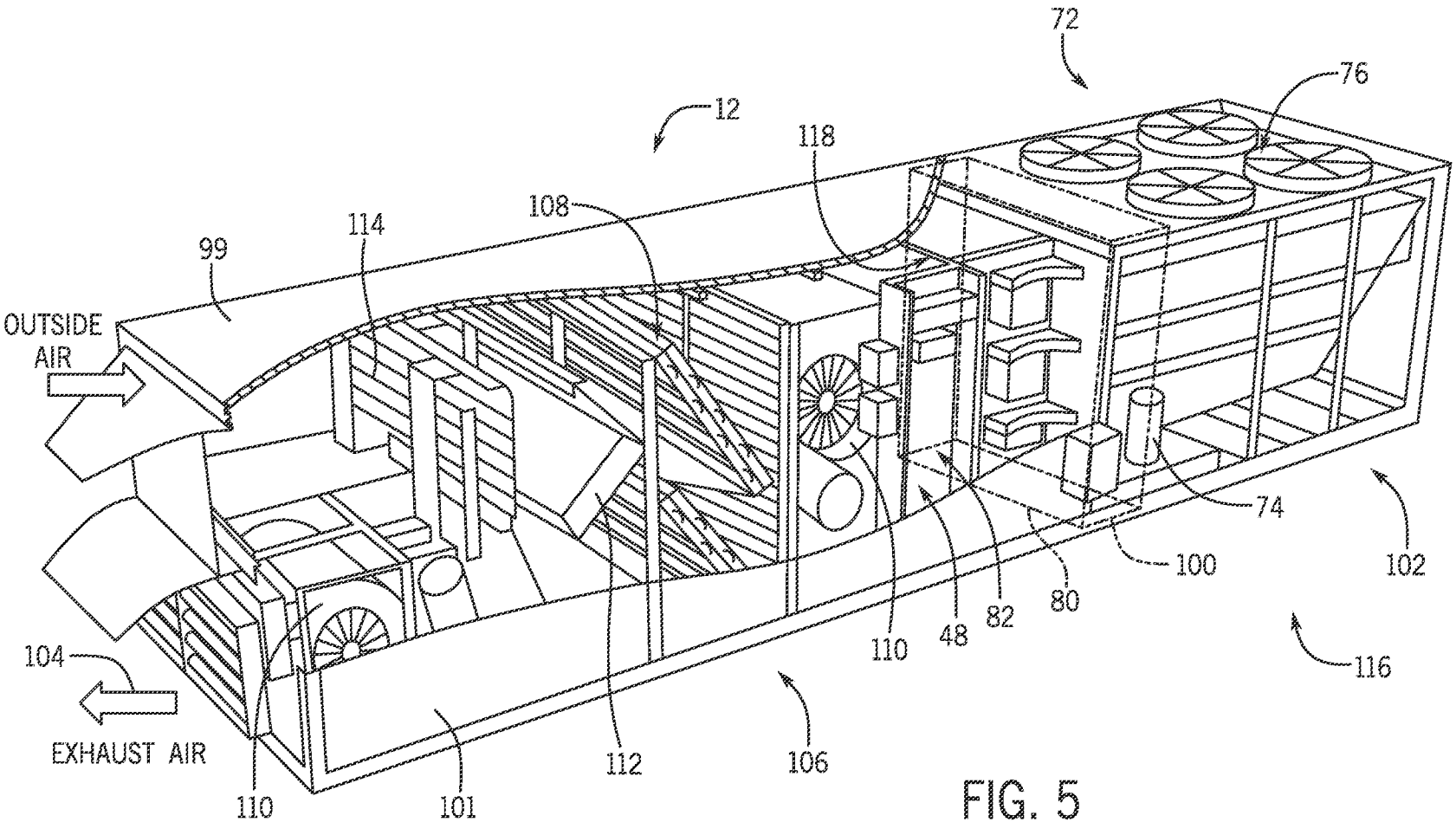
FIG. 5 is a perspective view of an embodiment of a HVAC unit having an intermediate heat exchanger to isolate a refrigerant loop portion of the HVAC unit from an air handling portion of the HVAC unit, in accordance with an aspect of the present disclosure.

FIG. 5 is a perspective view of the HVAC unit 12 that may be disposed on a rooftop or otherwise outside of the building 10. As shown in the illustrated embodiment of FIG. 5, the HVAC unit 12 is a single-packaged unit that has a housing 99 and a variety of components disposed within the housing 99. For example, the HVAC unit 12 includes an intermediate heat exchanger 100, which in some embodiments may be the evaporator 80. In any case, the intermediate heat exchanger 100 is utilized to place refrigerant in a heat exchange relationship with an intermediate cooling fluid, such that the refrigerant is isolated from an airflow into the building 10. As shown in the illustrated embodiment of FIG. 5, the HVAC unit 12 includes the compressor 74, the condenser 76, and the evaporator 80. As shown in the illustrated embodiment of FIG. 5, the evaporator 80 is positioned adjacent to the condenser 76 and serves as the intermediate heat exchanger 100. In existing units, the evaporator 80 may be positioned outside of a condensing section 102 of the HVAC unit 12. In such units, the evaporator 80 directly exchanges heat with an airflow 104 that is ultimately directed to the building 10. As discussed above, it is now recognized that isolating components of the HVAC unit 12 that circulate refrigerant from the airflow 104 may block, reduce, and/or eliminate refrigerant from mixing with the airflow 104. Accordingly, embodiments of the present disclosure are directed to the HVAC unit 12 having the intermediate heat exchanger 100, for example the evaporator 80, which includes a fluid-to-fluid heat exchanger that enables the refrigerant flowing through the vapor compression system 72 to exchange heat with an intermediate working fluid, such as water, glycol, a water-glycol mixture, carbon dioxide ($CO_2$), and/or a low GWP refrigerant. As such, the intermediate heat exchanger 100 isolates refrigerant from the airflow 104 through the HVAC unit 12.

In some embodiments, the intermediate heat exchanger 100 includes a brazed plate heat exchanger to enable heat transfer between the refrigerant and the intermediate working fluid. For example, the brazed plate heat exchanger may include a plurality of corrugated plates disposed within a housing. The plurality of corrugated plates may be brazed to one another to form channels that direct the refrigerant and the intermediate working fluid along predetermined paths through the housing, while isolating the refrigerant from the intermediate working fluid. Further, the plurality of corrugated plates may include a metallic material, such as copper, aluminum, or another suitable material, to facilitate transfer of thermal energy between the refrigerant and the intermediate working fluid. In some embodiments, the brazed plate heat exchanger may include two, three, four, five, six, seven, eight, nine, ten, or more of the corrugated plates. In other embodiments, the intermediate heat exchanger 100 includes another suitable heat exchanger, such as a shell and tube heat exchanger, a plate and fin heat exchanger, or another suitable fluid-to-fluid heat exchanger that enables transfer of thermal energy between the refrigerant and the intermediate working fluid.

Further, the HVAC unit 12 includes an air handling portion 106 having a heat exchanger 108 that enables heat transfer between the airflow 104 and the intermediate working fluid. For example, one or more fans or blowers 110 direct air across coils of the heat exchanger 108, such that the airflow 104 absorbs heat from, or transfers heat to, the intermediate working fluid in the heat exchanger 108. The airflow 104 is then directed into the building 10 at a predetermined temperature to either heat or cool the building 10. Additionally, in some embodiments, the HVAC unit 12 may include a filter section 112, an economizer 114, the control board 48 and/or the control panel 82, and/or other components that enable the HVAC unit 12 to heat or cool the airflow 104 directed into the building 10.

In some embodiments, the air handling portion 106 of the HVAC unit 12 is separated from a refrigeration loop portion 116 of the HVAC unit 12 via a barrier 118 that is impermeable to the airflow 104 and/or the refrigerant. As shown in the illustrated embodiment of FIG. 5, the compressor 74, the condenser 76, and the intermediate heat exchanger 100 are each disposed in the refrigerant loop portion 116 of the HVAC unit 12. As such, refrigerant that inadvertently escapes from conduits of the refrigerant loop portion 116 is isolated from the airflow 104 via the barrier 118. The barrier 118 thus blocks refrigerant from flowing from the refrigerant loop portion 116 into the air handling portion 106. In some embodiments, the airflow 104 is substantially free of refrigerant 140. For example, the airflow 104 contains less than 10% refrigerant by weight, less than 5% refrigerant by weight, less than 1% refrigerant by weight, less than 0.5% refrigerant by weight, or less than 0.1% refrigerant by weight. Further, the air handling portion 106 of the HVAC unit 12 may include a pressure that is less than a pressure of the ambient atmosphere surrounding the refrigeration loop portion 116. In other words, the air handling portion 106 is pressurized to facilitate heat transfer between the airflow 104 and the heat exchanger 108, such that the airflow 104 reaches a predetermined temperature before entering the building 10 through the ductwork 14, for example.

Figure 6:
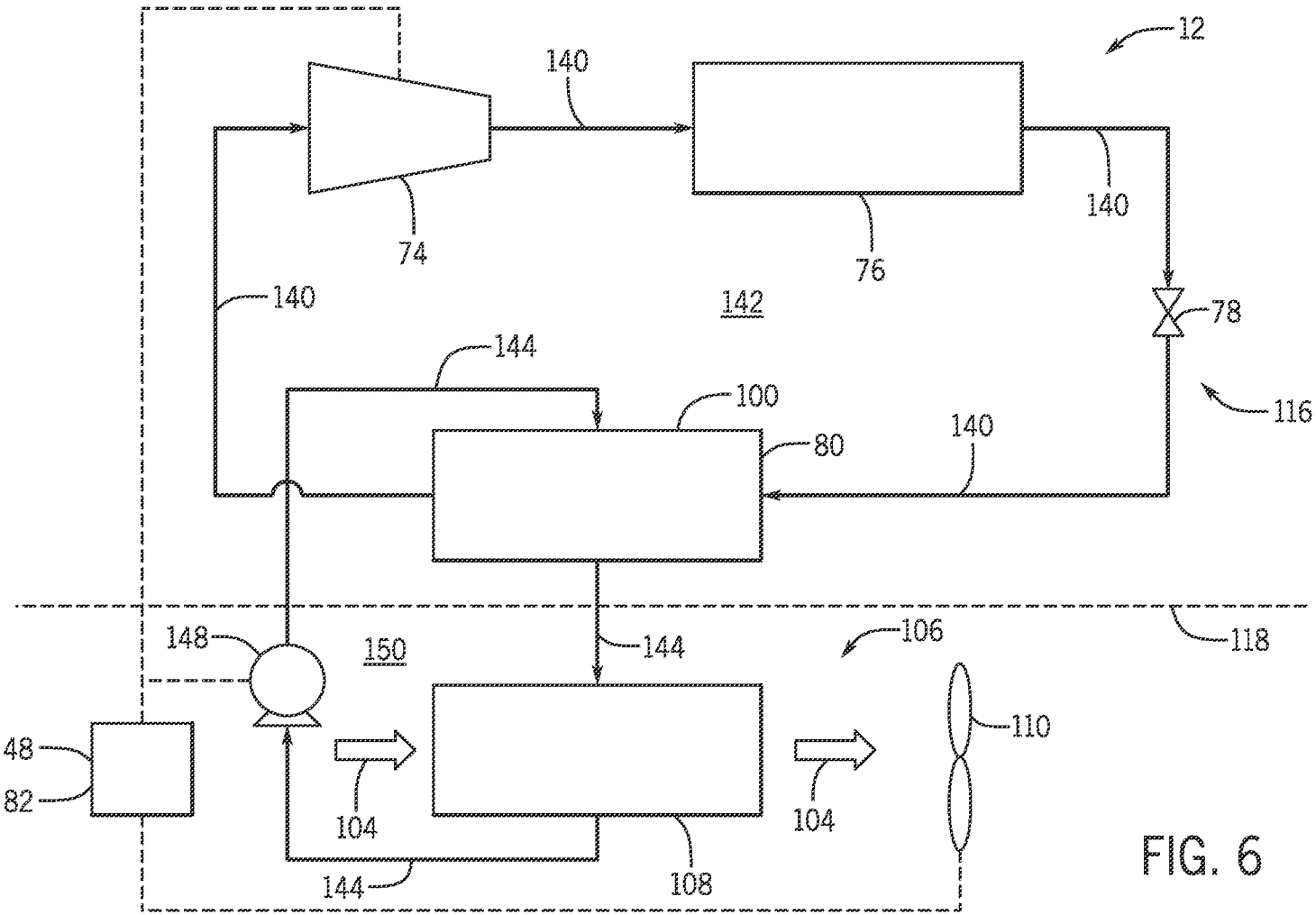
FIG. 6 is a schematic, block diagram of an embodiment of the HVAC unit of FIG. 5, in accordance with an aspect of the present disclosure.

FIG. 6 is a schematic, block diagram of an embodiment of the HVAC unit 12 that includes the intermediate heat exchanger 100 for isolating refrigerant 140 circulating through a refrigerant loop 142 from the airflow 104 to the building 10. As shown in the illustrated embodiment of FIG. 6, the refrigerant 140 is directed through the refrigerant loop 142 by the compressor 74. The refrigerant 140 that is discharged from the compressor 74 is directed into the condenser 76, which reduces a temperature of the refrigerant 140. For example, the condenser 76 may place the refrigerant 140 in a heat exchange relationship with a cooling fluid, such as water, air, glycol, or another suitable cooling fluid, which absorbs heat from the refrigerant 140 to reduce the temperature of the refrigerant. Further in some embodiments, the refrigerant 140 exiting the condenser 76 is directed to the expansion device 78, which reduces the pressure, and thus further reduces the temperature, of the refrigerant 140.

The refrigerant 140 is then directed from the expansion device 78 to the intermediate heat exchanger 100, which acts as the evaporator 80. As shown in the illustrated embodiment of FIG. 6, the intermediate heat exchanger 100 is configured to receive both the refrigerant 140 and an intermediate working fluid 144. The intermediate heat exchanger 100 thus places the refrigerant 140 into a heat exchange relationship with the intermediate working fluid 144 and isolates the refrigerant 140 from the airflow 104. For example, the intermediate working fluid 144 flowing from the intermediate heat exchanger 100 is directed into the heat exchanger 108 that places the intermediate working fluid 144 into a heat exchange relationship with the airflow 104. In other words, the heat exchanger 108 may include coils that circulate the intermediate working fluid 144, while the airflow 104 flows over the coils to absorb heat from, or transfer heat to, the intermediate working fluid 144.

In some embodiments, the one or more fans or blowers 110 directs the airflow 104 across the coils of the heat exchanger 108. Further, a pump 148 may be disposed along an intermediate working fluid loop 150 to circulate the intermediate working fluid 144 between the intermediate heat exchanger 100 and the heat exchanger 108. In certain embodiments, the fan 110 and/or the pump 148 may be coupled to the control board 48 and/or the control panel 82. The control board 48 and/or the control panel 82 may be configured to adjust a speed at which the fan 110 and/or the pump 148 operate to control a flow rate of the airflow 104 and/or the intermediate working fluid 144, respectively. For example, the speed of the fan 110 may be adjusted based on a temperature in the building 10, a flow rate of the intermediate working fluid 144, a temperature of the intermediate working fluid 144, an ambient air temperature, a temperature of the airflow 104, and/or another suitable operating parameter of the HVAC unit 12. Further, the speed of the pump 148 may be adjusted based on a temperature of the refrigerant 140 in the intermediate heat exchanger 100, a flow rate of the refrigerant 140 through the refrigerant loop 142, an ambient air temperature, a temperature in the building 10, and/or another suitable operating parameter of the HVAC unit 12. In any case, the control board 48 and/or the control panel 82 is configured to adjust the fan 110 and/or the pump 148 to achieve a predetermined temperature within the building 10.

As discussed above, the HVAC unit 12 may include the barrier 118 that separates the HVAC unit 12 into the refrigerant loop portion 116 and the air handling portion 106. The air handling portion 106 is sealed from the refrigerant loop portion 116 and is pressurized to facilitate a flow of the airflow 104 from the heat exchanger 108 to the building 10. Additionally, should any of the refrigerant 140 escape from the refrigerant loop 142, such as from a leak caused by an opening in a conduit or coupling device of the refrigerant loop 142, the refrigerant 140 does not mix with the airflow 104 that is directed into the building 10. In some embodiments, the airflow 104 is substantially free of refrigerant 140. For example, the airflow 104 contains less than 10% refrigerant by weight, less than 5% refrigerant by weight, less than 1% refrigerant by weight, less than 0.5% refrigerant by weight, or less than 0.1% refrigerant by weight.

Figure 7:
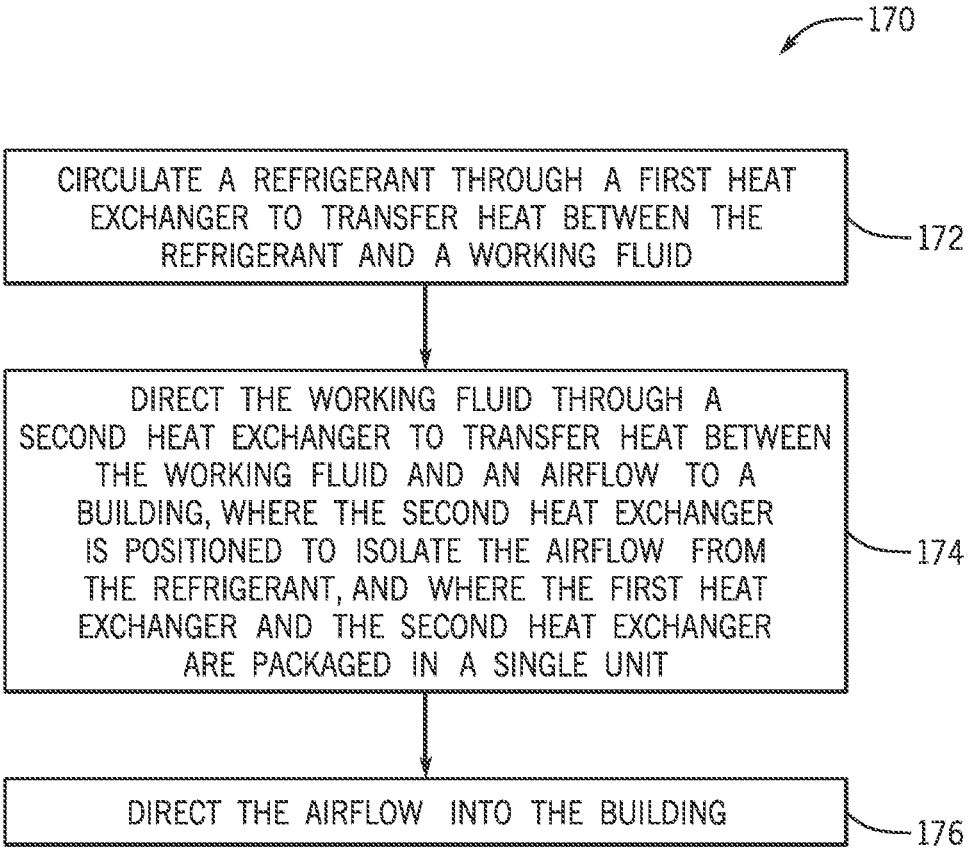
FIG. 7 is a block diagram of an embodiment of a process that is utilized to operate the HVAC unit of FIGS. 5 and 6, in accordance with an aspect of the present disclosure.

FIG. 7 is a flow chart of an embodiment of a process 170 for operating the HVAC unit 12 of FIGS. 5 and 6. For example, at block 172, the refrigerant 140 is circulated through the intermediate heat exchanger 100 of the refrigerant loop 142 to transfer heat between the refrigerant 140 and the intermediate working fluid 144. As discussed above, the intermediate heat exchanger 100 may be a brazed plate heat exchanger that facilitates transfer of thermal energy, or heat, between the refrigerant 140 and the intermediate working fluid 100. In other embodiments, the intermediate heat exchanger 100 may include another suitable fluid-to-fluid heat exchanger.

At block 174, the intermediate working fluid 144 is directed from the intermediate heat exchanger 100 to the heat exchanger 108 to transfer heat between the intermediate working fluid 144 and the airflow 104. As discussed above, the heat exchanger 108 is positioned in the air handling portion 106 of the HVAC unit 12, which is isolated from the refrigerant loop portion 116 of the HVAC unit 12 via the barrier 118. Accordingly, the airflow 104 is isolated from the refrigerant 140 and does not mix with refrigerant 140 that escapes from the refrigerant loop 142. In other words, the barrier 118 is impermeable to a flow of the airflow 104 and the refrigerant 140 to block refrigerant 140 that escapes from the refrigerant loop 142 from flowing into the air handling portion 106 of the HVAC unit 12. Accordingly, the airflow 104 is then directed into the building 10 and the airflow 104 is substantially free of refrigerant 140. For example, the airflow 104 contains less than 10% refrigerant by weight, less than 5% refrigerant by weight, less than 1% refrigerant by weight, less than 0.5% refrigerant by weight, or less than 0.1% refrigerant by weight.

As set forth above, the intermediate heat exchanger of the present disclosure may provide one or more technical effects useful in the operation of HVAC systems to isolate refrigerant from an airflow into a building. For example, embodiments of the present approach may isolate refrigerant of an HVAC unit from an airflow that is ultimately directed into a building to heat or cool the building using the intermediate heat exchanger. The intermediate heat exchanger transfers heat between the refrigerant flowing through a refrigerant loop and an intermediate working fluid. The intermediate working fluid flows into a heat exchanger of an air handling portion of the HVAC unit and exchanges heat with the airflow into the building. In some embodiments, a refrigerant loop portion of the HVAC unit is isolated from the air handling portion via a barrier. In any case, refrigerant that inadvertently escapes from the refrigerant loop is blocked from flowing into the air handling portion, and thus, the refrigerant is isolated from the airflow and does not mix with the airflow. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode, or those unrelated to enablement). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilating, and air conditioning (HVAC) system, comprising:

a housing;

a refrigerant loop portion disposed within the housing, wherein the refrigerant loop portion comprises:

a compressor disposed along a refrigerant loop, wherein the compressor is configured to circulate a refrigerant through the refrigerant loop;

a first heat exchanger disposed along the refrigerant loop, wherein the first heat exchanger is disposed in a portion of the housing exposed to an ambient environment surrounding the housing, and wherein the first heat exchanger is configured to place the refrigerant in a first heat exchange relationship with ambient air received from the ambient environment; and a second heat exchanger disposed along the refrigerant loop and along an intermediate working fluid loop, wherein the second heat exchanger is configured to place the refrigerant in a second heat exchange relationship with a working fluid;

an air handling portion disposed within the housing, wherein the air handling portion comprises:

a third heat exchanger disposed along the intermediate working fluid loop and within an airflow path of the air handling portion, wherein the third heat exchanger is configured to place the working fluid in a third heat exchange relationship with an airflow directed along the airflow path, wherein the air handling portion is configured to receive a flow of outside air into the housing and is configured to discharge the airflow from the housing and into a building; and a barrier disposed within the housing between the refrigerant loop portion and the air handling portion, wherein the barrier is configured to isolate the refrigerant loop portion from the air handling portion.

2. The HVAC system of claim 1, wherein the air handling portion is configured to discharge exhaust air from the housing.

3. The HVAC system of claim 2, wherein the air handling portion comprises an economizer.

4. The HVAC system of claim 1, wherein the air handling portion comprises a filter disposed within the housing, wherein the filter is configured to filter the airflow.

5. The HVAC system of claim 1, wherein the air handling portion comprises a blower configured to force the airflow along the airflow path.

6. The HVAC system of claim 1, wherein the barrier is impermeable to air.

7. The HVAC system of claim 1, wherein the working fluid comprises water, glycol, a water-glycol mixture, carbon dioxide, or a combination thereof.

8. The HVAC system of claim 1, wherein the refrigerant comprises R32, R534, R290, R452B, R455A, R1234yf, ammonia, or a combination thereof.

9. The HVAC system of claim 1, wherein the refrigerant loop portion and the air handling portion are disposed within the housing in an end-to-end arrangement.

10. A heating, ventilating, and air conditioning (HVAC) system, comprising:

a housing;

a refrigerant loop disposed within the housing, wherein the refrigerant loop comprises:

a compressor configured to circulate a refrigerant through the refrigerant loop;

a first heat exchanger disposed in a portion of the housing exposed to an ambient environment surrounding the housing, wherein the first heat exchanger is configured to place the refrigerant in a first heat exchange relationship with ambient air received from the ambient environment; and a second heat exchanger configured to place the refrigerant in a second heat exchange relationship with a working fluid;

an air handling unit disposed within the housing, wherein the air handling unit comprises:

a third heat exchanger disposed within an airflow path of the air handling unit, wherein the third heat exchanger is configured to place the working fluid in a third heat exchange relationship with an airflow directed along the airflow path, wherein the air handling unit is configured to receive a flow of outside air into the housing and to discharge the airflow from the housing and into a building; and a barrier disposed within the housing between the refrigerant loop and the air handling unit, wherein the barrier is configured to isolate the refrigerant loop from the air handling unit.

11. The HVAC system of claim 10, wherein the working fluid comprises water, glycol, a water-glycol mixture, carbon dioxide, or a combination thereof.

12. The HVAC system of claim 10, wherein the air handling unit comprises a fan configured to direct the airflow across the third heat exchanger and into ductwork of the building.

13. The HVAC system of claim 12, comprising a control board configured to adjust a speed of the fan based on one or more operating parameters of the HVAC system.

14. The HVAC system of claim 10, comprising an intermediate working fluid loop disposed within the housing, wherein the intermediate working fluid loop is configured to circulate the working fluid between the second heat exchanger and the third heat exchanger.

15. The HVAC system of claim 14, wherein the intermediate working fluid loop comprises a pump configured to direct the working fluid along the intermediate working fluid loop.

16. The HVAC system of claim 15, comprising a control board configured to adjust a speed of the pump based on one or more operating parameters of the HVAC system.

17. A heating, ventilating, and air conditioning (HVAC) unit, comprising:

a housing comprising a refrigerant loop portion, an air handling portion, and a barrier disposed therein, wherein the barrier extends between the refrigerant loop portion and the air handling portion and is configured isolate the refrigerant loop portion from the air handling portion, wherein the refrigerant loop portion comprises:

a first heat exchanger disposed along a refrigerant loop, wherein the first heat exchanger is disposed in a portion of the housing exposed to an ambient environment surrounding the housing and is configured to place a refrigerant in a first heat exchange relationship with ambient air received from the ambient environment; and a second heat exchanger disposed along the refrigerant loop and configured to place the refrigerant in a second heat exchange relationship with a working fluid, and wherein the air handling portion comprises:

a third heat exchanger disposed within an airflow path of the air handling portion, wherein the third heat exchanger is configured to place the working fluid in a third heat exchange relationship with an airflow directed along the airflow path, wherein the air handling portion is configured to receive a flow of outside air into the housing and is configured to discharge the airflow from the housing and into a building.

18. The HVAC unit of claim 17, comprising:

an intermediate working fluid loop disposed within the housing, wherein the intermediate working fluid loop is configured to circulate the working fluid between the second heat exchanger and the third heat exchanger;

a pump disposed along the intermediate working fluid loop and configured to control a flow rate of the working fluid through the intermediate working fluid loop; and a blower disposed within the air handling portion, wherein the blower is configured to direct the airflow across the third heat exchanger and into ductwork of the building.

19. The HVAC unit of claim 18, comprising a control board configured to control operation of the pump and the blower based on an ambient air temperature, a temperature within the building, or both.

* * * * *